US005596852A

United States Patent [19]

Schiedegger

[11] Patent Number: 5,596,852

[45] Date of Patent: Jan. 28, 1997

[54] PLASTIC BUILDING PRODUCT

[75] Inventor: Charles E. Schiedegger, Metamora, Mich.

[73] Assignee: Mid-America Building Products Corporation, Plymouth, Mich.

[21] Appl. No.: 277,734

[22] Filed: Jul. 20, 1994

[51] Int. Cl.[6] ..... F06B 1/04

[52] U.S. Cl. ..... 52/212; 52/211; 52/204.54; 52/302.1; 52/198

[58] Field of Search ..... 52/211, 212, 217, 52/204.54, 204.56, 473, 302.1, 198, 199, 202, 60

[56] References Cited

U.S. PATENT DOCUMENTS

| | | | |
|---|---|---|---|
| 2,752,844 | 7/1956 | Simblest . | |
| 2,960,734 | 11/1960 | Collins | 52/217 |
| 3,500,600 | 3/1970 | Bagley . | |
| 4,280,309 | 7/1981 | Huelsekopf | 52/204.54 |
| 4,389,824 | 6/1983 | Anderson . | |
| 4,407,100 | 10/1983 | Huelsekopf . | |
| 4,635,168 | 1/1987 | Crowley . | |
| 4,726,152 | 2/1988 | Vagedes . | |
| 4,782,630 | 11/1988 | Kleyn | 52/217 X |
| 4,787,184 | 11/1988 | Boidron | 52/217 |
| 4,875,318 | 10/1989 | MacLeod et al. | 52/211 |
| 4,920,708 | 5/1990 | MacLeod . | |
| 5,326,060 | 7/1994 | Chubb et al. | 248/231.9 |
| 5,349,799 | 9/1994 | Schiedegger et al. | 52/473 |
| 5,397,093 | 3/1995 | Chubb et al. | 248/544 |

*Primary Examiner*—Robert Canfield

*Attorney, Agent, or Firm*— Barnes, Kisselle, Raisch, Choate, Whittemore & Hulbert, P.C.

[57] ABSTRACT

A plastic building product comprising a plastic body having a base, an integral continuous wall extending from the base, and a plurality of integral wall segments spaced radially outwardly from the base and defining a space therebetween, a plurality of plastic flange members. Each flange member including spaced integral walls connected by an integral wall. One of the walls of each flange member extending into the space between the peripheral wall and the wall segments of the plastic body.

7 Claims, 3 Drawing Sheets

PLASTIC BUILDING PRODUCT

This invention relates to plastic building products such as louvers and windows.

BACKGROUND AND SUMMARY OF THE INVENTION

In the construction of plastic building products, it has been known to provide a movable flange member that is provided about a plastic body to overlie portions of abutting siding or the like. Typical patents showing such products and U.S. Pat. Nos. 4,875,318 and 4,920,708.

In the U.S. Pat. Nos. 4,875,318 there is disclosed and claimed a plastic building product for placement on the wall of a building to provide a louver or window wherein siding abuts the product the product comprises a plastic body having a peripheral wall circumscribing the louver or window, an integral flange extending laterally from the wall for fastening the body to the wall of a building, and a movable flange member telescoped over the peripheral wall of the body. The flange member includes a laterally extending flange adapted to overly portions of abutting siding or the like. The flange member and the peripheral wall include interengaging portions for selectively positioning the flange member at predetermined distances which respect to the flange on the body to accommodate siding of varying thickness.

Among the objectives of the present invention are to provide a plastic product which has a sectional flange; which can accommodate siding of different thicknesses; and which is readily assembled and disassembled.

In accordance with the invention, a plastic body is provided having a base, an integral continuous peripheral wall extending from the base and a plurality of integral wall segments spaced radially outwardly from the peripheral wall and defining a space therebetween. A plurality of flange members are provided each of which include spaced walls connected by an integral wall. One of the spaced walls extends into the space between the continuous wall of the plastic body and the segmented walls of the plastic body. The other of the walls extends toward the siding that is positioned on the building and projects beneath the flange segments. The flange segments are configured to abut one another thereby giving the appearance of a continuous flange. Interengaging teeth are provided on one of the walls of the plastic body and engage recesses or openings in the flange that extends there between.

DESCRIPTION OF THE PREFERRED EMBODIMENT

Figure 1:
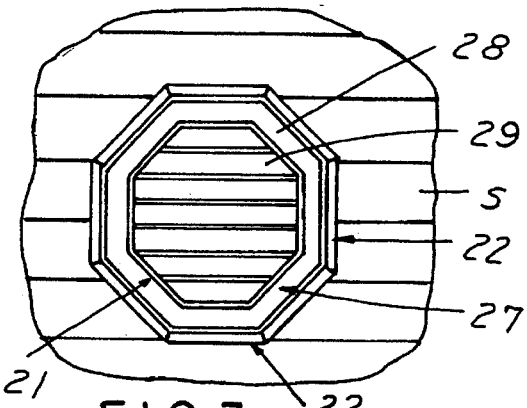
FIG. 1 is a fragmentary front elevational view of a plastic product embodying the invention shown in position on a building.
Figure 2:
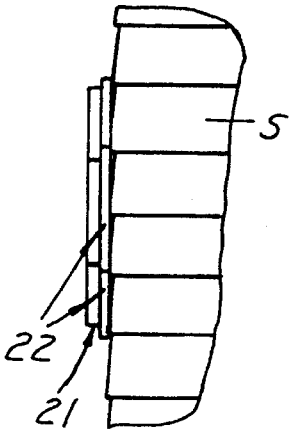
FIG. 2 is a fragmentary side elevational view.
Figure 3:
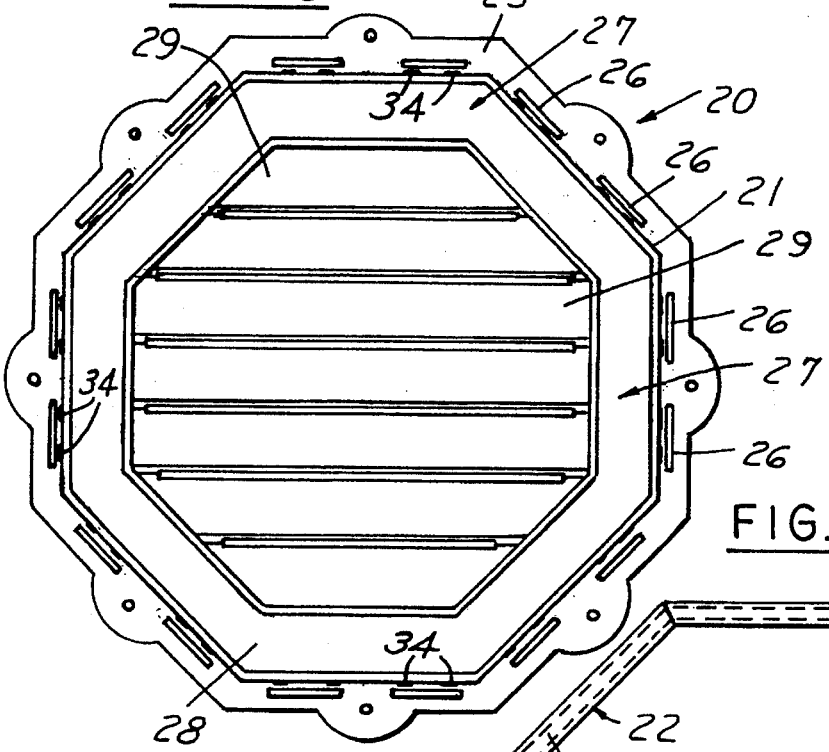
FIG. 3 is a plan view of the plastic product embodying the invention with the flange members removed.

Referring to FIGS. 1 and 2, the invention is shown in connection with use as a louver over an opening in a building. The plastic building product 20 comprises a plastic body 21 and a plurality of flange members 22. The body 21 is fastened to the wall of the building and the flange members 22 are provided there over after the siding S has been applied and connected to the plastic body as presently described.

As shown in FIGS. 3, 4 and 5–8, the plastic body 21 includes a base portion 23 which has an opening 24 therein and spaced integral walls 25, 26 that extend at a right angle to the base 23. Wall 25 defines an integral continuous wall with, the base herein shown as octagonal. The wall can be round, triangular or any other annular shape. The outer wall 26 is in the form of segments spaced from one another, herein shown as two segments along each side of the octagon. The plastic product 21 further includes an integral front wall 27 that has a continuous periphery extending from the outer edge of the wall 25 and integral louvers 29 which are parallel to one another in the front wall 25.

Figure 4:
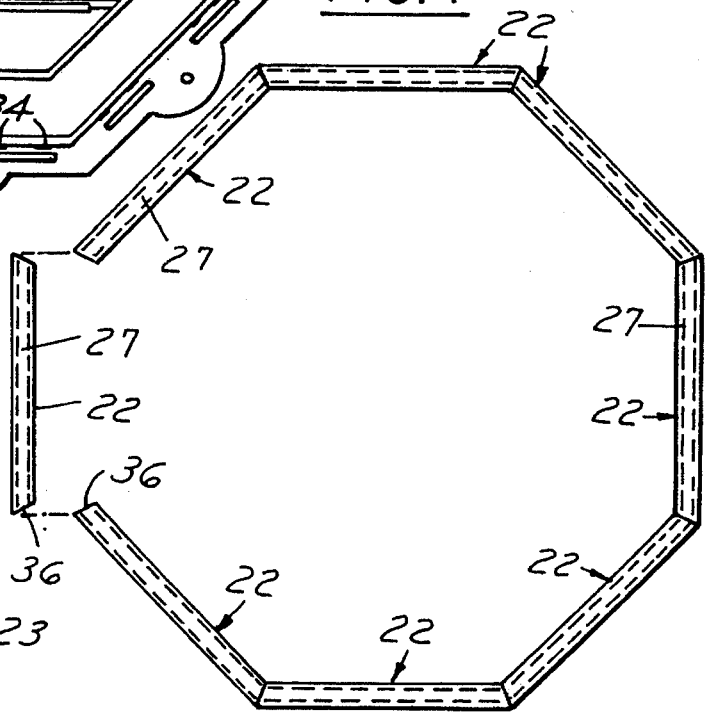
FIG. 4 is a plan view of the flange members, one flange member being out of position.
Figure 5:
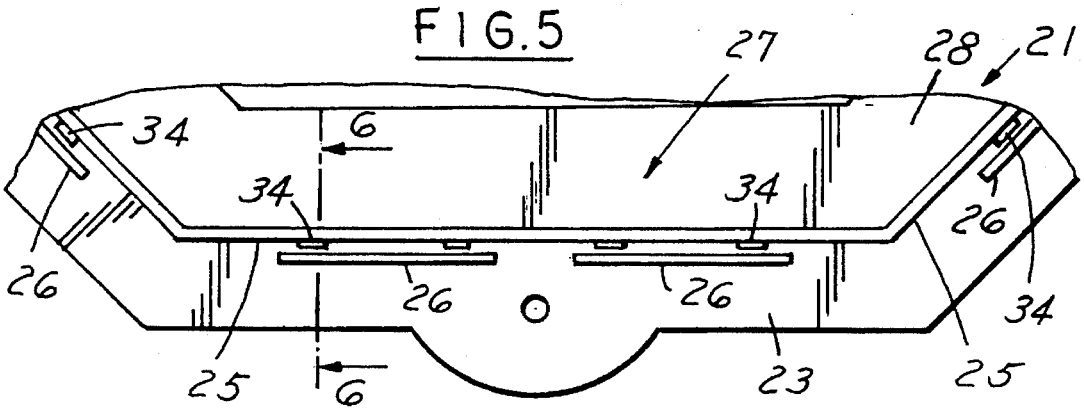
FIG. 5 is a fragmentary plan view on an enlarged scale of the plastic base member shown in FIG. 3.
Figure 6:
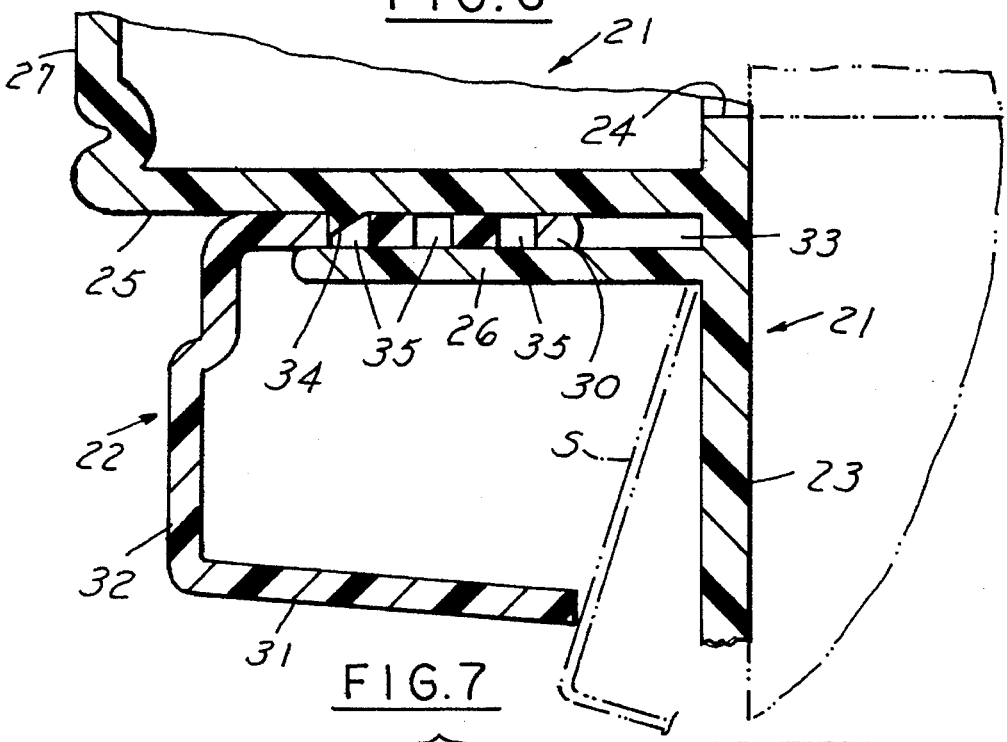
FIG. 6 is a fragmentary sectional view on an enlarged scale taken along lines 6—6 in FIG. 5.
Figure 7:
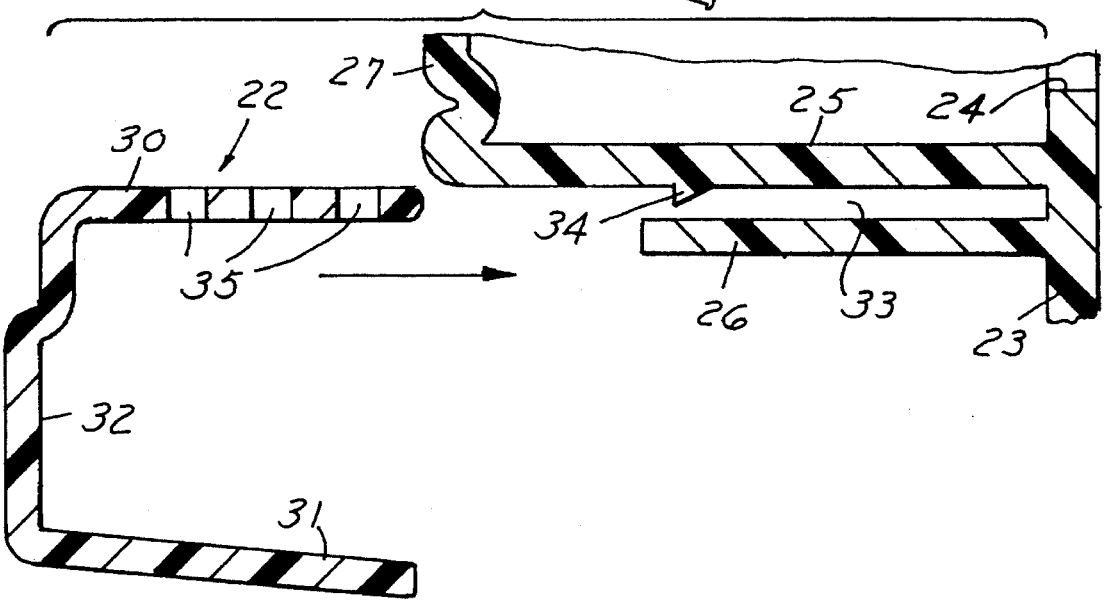
FIG. 7 is an exploded view of the portion of the plastic product shown in FIG. 6.

Referring to FIGS. 4, 6 and 7, each flange segment 22 includes an inner wall 30 and outer wall 31 which are connected to one another by an integral transverse wall 32. The inner wall 30 is adapted to extend in the space 33 between the walls 25 and wall segments 26 and be held in position thereon by one or more teeth 34 on the outer surface of the inner wall 25 which engage one of the axially spaced openings 35 in the wall 30. As shown in FIG. 5, the teeth 34 extend into the space 33 adjacent the segments 26.

In use, the plastic body 21 is mounted about the opening in a building, the siding S is thereafter applied to abut the wall segments 26 and then the flange members 22 are telescoped into the spaces 33 to complete the flange. Each flange member 22 includes surfaces 36 which are shaped to abut complementary surfaces 36 on the adjacent segments 22 to complete the flange about the periphery plastic body.

Figure 8:
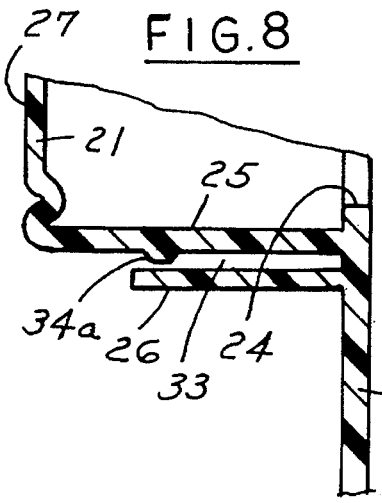
FIG. 8 is a fragmentary sectional on an enlarged scale of a modified form of the invention.

In the modified form shown in FIG. 8, the teeth **34*a*** are trapezoidal in cross section.

Figure 9:
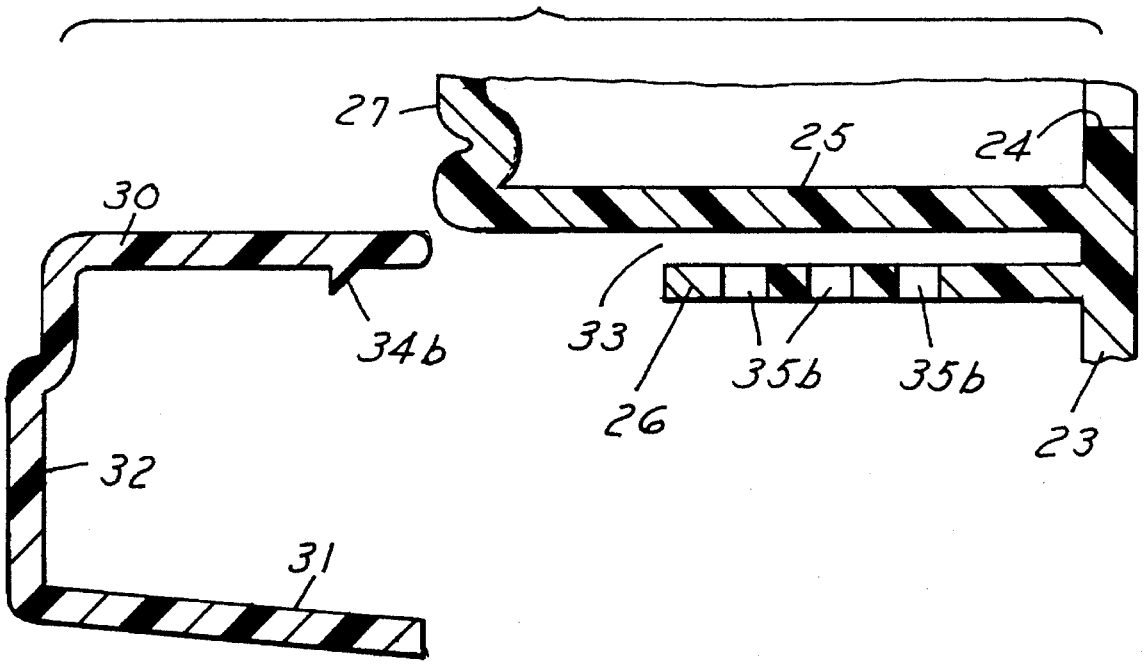
FIG. 9 is a fragmentary sectional view on an enlarged scale of another modified form of the invention.

In the form shown in FIG. 9, the axially spaced openings **35*b* are in the walls 26, which are more flexible than continuous inner wall 25, and the tooth 34*b* is on the outer surface of the inner wall 30** of the flange segments.

It can thus be seen that there has been provided a plastic product which has a sectional flange; which can accommodate siding of different thicknesses; and which is readily assembled and disassembled.

What is claimed is:

1. A plastic building product comprising a plastic body having a flat base, an integral continuous annular wall extending at a right angle from the base, a plurality of integral wall segments spaced radially outwardly from said continuous wall to define spaces between the wall segments and continous wall, said wall segments circumferentially spaced from one another and extending outwardly from said base, said base having portions extending radially outwardly for mounting said plastic body on a building, a plurality of plastic flange members, each said flange member including spaced integral walls and an integral wall connecting said spaced integral walls, said spaced integral walls comprising an outer wall and an inner wall, the inner integral wall of each said flange member extending into the space between said continuous wall and respective integral wall segments of said plastic body, integral interengaging means on said inner integral walls and on said continuous wall such that the said integral walls can be held in a plurality of positions to accommodate siding of different thicknesses, said integral interengaging means comprising the sole means for holding said flange members on said continuous wall, said flange members have a length such that adjacent flange members abut to provide the appearance of a continuous flange.

2. The plastic building product set forth in claim 1 wherein ends of said flange members have a configuration such that adjacent flange members abut across the entire width thereof.

3. The plastic building product set forth in claim 1 wherein said continuous wall has an outer surface, said interengaging means comprises integral teeth on the outer surface of said continuous wall of said body and a plurality of axially spaced openings on said inner wall of said flange members selectively engaged by said teeth.

4. The plastic building product set forth in claim 3 wherein said teeth are triangular in axial cross section.

5. The plastic building product set forth in claim 3 wherein said teeth are trapezoidal in axial cross section.

6. The plastic building product set forth in claim 1 wherein said interengaging means comprises integral teeth on the outer surface of said inner wall of said flange members and axially spaced opening on said integral wall segments of said body.

7. The plastic building product set forth in claim 1 wherein said continuous wall is polygonal, each said wall segment being along a side of said polygonal wall.

* * * * *